United States Patent [19]

Maxson et al.

[11] 4,011,615

[45] Mar. 15, 1977

[54] PERSONNEL TRANSFER GANGWAY

[75] Inventors: Orwin G. Maxson; Marvin L. Peterson, both of Ponca City, Okla.

[73] Assignee: Continental Oil Company, Ponca City, Okla.

[22] Filed: Nov. 12, 1975

[21] Appl. No.: 631,016

[52] U.S. Cl. ..... 14/71.1; 14/71.5

[51] Int. Cl.[2] ..... E01D 1/00

[58] Field of Search ..... 14/71; 114/.5 R, .5 BD; 105/358; 61/48; 214/15 E, 15 A

[56] References Cited

UNITED STATES PATENTS

| | | | |
|---|---|---|---|
| 821,770 | 5/1906 | Truax | 61/48 |
| 2,527,653 | 10/1950 | Pierce | 14/71 |
| 2,641,785 | 6/1953 | Pitts | 14/71 |
| 2,803,841 | 8/1957 | Wellens | 14/71 |
| 2,828,497 | 4/1958 | Matthews | 14/71 |
| 3,004,391 | 10/1961 | Miller | 61/48 |
| 3,008,158 | 11/1961 | Stinson | 14/71 |
| 3,426,719 | 2/1969 | Mizell | 14/71 X |
| 3,571,836 | 3/1971 | Dunlap | 14/71 |

*Primary Examiner*—Nile C. Byers, Jr.
*Attorney, Agent, or Firm*—William J. Miller

[57] ABSTRACT

A gangway for transferring personnel between a ship and a fixed structure is formed by first and second mating extensible members which are arranged to form a platform. Springs are mounted inside the platform which permit the first and second members to elongate or shorten about a neutral point in order to accommodate a movement of the ship during heavy seas. Attaching devices are provided in each end of the gangway to secure it to the ship and to the fixed structure, respectively. An elastic tread can be placed on the gangway so that, when the gangway elongates or shortens, personnel walking on the gangway will not be injured or lose footing. A plurality of hoops can be attached along the gangway with elastic material stretched between the hoops and covering same so that, should personnel momentarily lose their footing, they will not be thrown overboard.

4 Claims, 8 Drawing Figures

PERSONNEL TRANSFER GANGWAY

DESCRIPTION OF THE PRIOR ART

Personnel gangways designed for connection between a ship and a fixed platform have been of the rigid type. Means are generally incorporated to position the gangway with respect to the ship and to securely tie the ship to the gangway. Such devices are shown in the patents to Mizell, No. 3,426,719; Stinson, No. 3,008,158; and Miller, No. 3,004,391. The patent to Miller and the patent to Stinson do include a limited means for vertical movement of the gangway. The only patent which illustrates a gangway having means to accommodate a large change in length is the patent to Wilson, No. 3,245,101. Rather than having a platform which will collapse or elongate in accordance with the ship attitude, the Wilson patent has a fairly flexible gangway formed in a narrow strip which passes over rollers and is weighted. As the ship moves away from the platform, the gangway will elongate by pulling more of the unused gangway over the roller.

BRIEF DESCRIPTION OF THE INVENTION

This invention contemplates a gangway which can accommodate a large amount of elongation or shortening and accomplishes same by elongating or shortening the gangway. An elastic mat covers the gangway so that changes in length will not cause injury or loss of footing to personnel passing over the gangway during a length change. Hoops are also provided which are covered with elastic material so that, if a person should during passage lose his footing, the cover of the gangway will prevent him from falling into the water.

BRIEF DESCRIPTION OF THE FIGURES

Referring to the drawings.

DETAILED DESCRIPTION OF THE FIGURES

Figure 1:
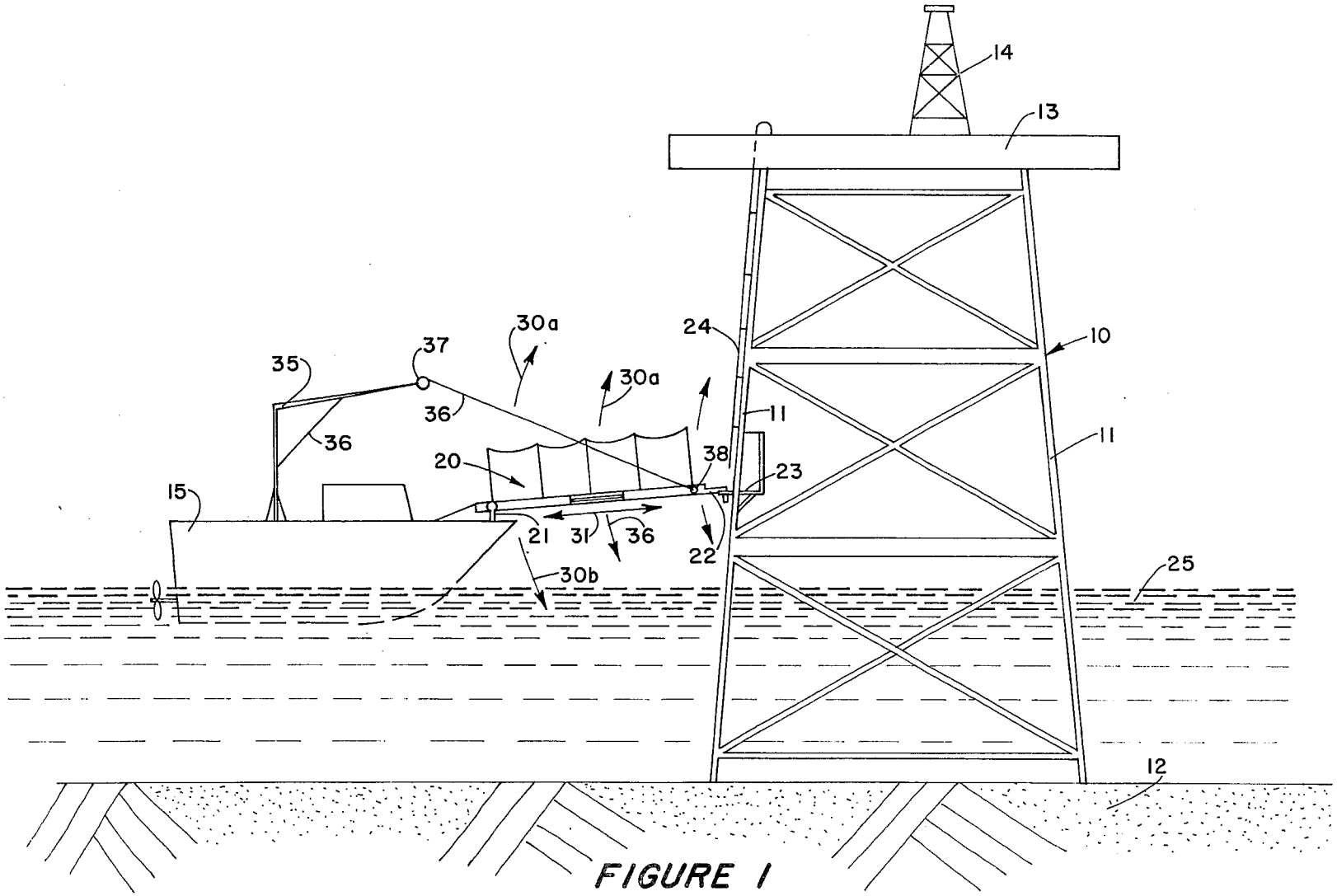
FIG. 1 illustrates a ship tied to a platform with the extensible connected between the ship and the platform.
Figure 3:
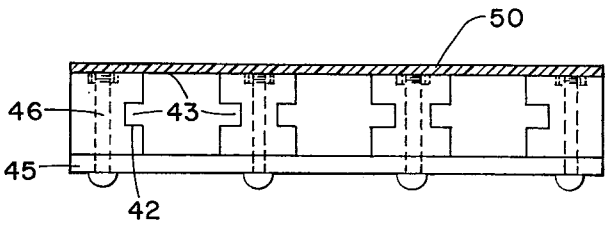
FIG. 3 is a side view of FIG. 2 taken through lines 3—3.
Figure 2:
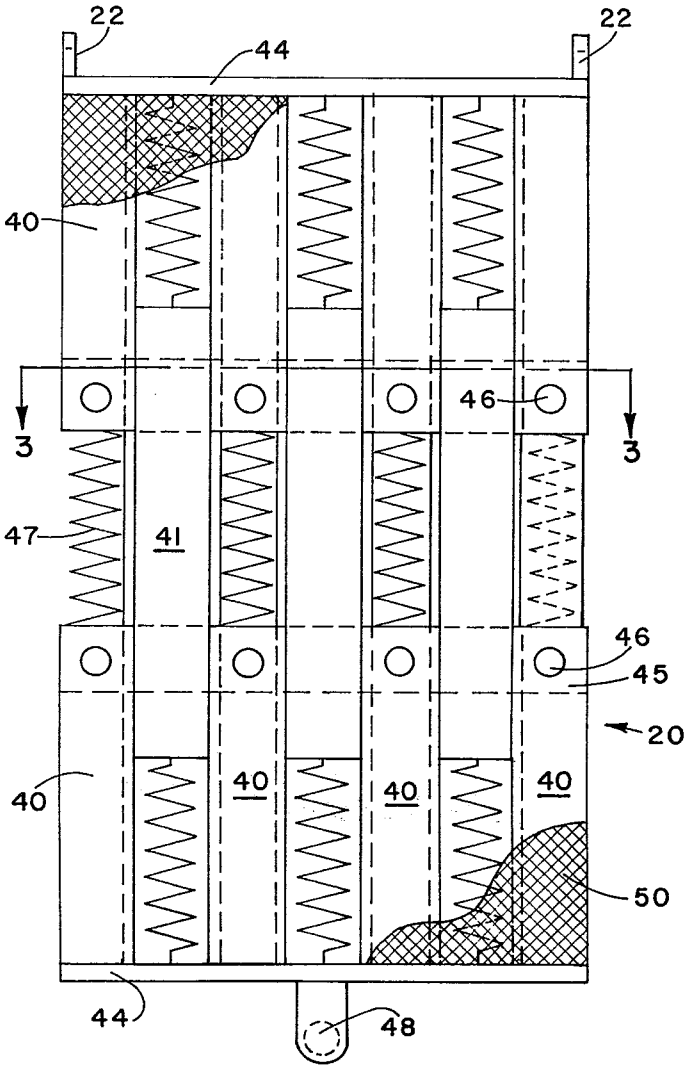
FIG. 2 is a top view of the preferred embodiment of this invention.

A general description of the gangway and its use is illustrated in FIG. 1. An offshore platform 10, for example, has a plurality of legs 11 attached to the ocean bed 12 in the usual manner. A deck 13 is attached to the upper end of legs 11 and will be mounted thereon the drilling structure 14, living quarters, etc.

In order to transfer personnel from the shore to platform 10, a ship 15 is provided. Once the ship 15 reaches platform 10, some means must be utilized to transfer the personnel from ship 15 to platform 10. This means is illustrated as a gangway 20 which is attached to ship 15 by a ball joint 21 at one end of gangway 20 and a hook engaging means 22 at the opposite end. A walkway 23 attached to platform 10 has means for receiving hooks 22 in order to anchor gangway 20 to platform 10. A ladder 24 can be used to permit access from walkway 23 to deck 13. Water 25 is supporting ship 15 and can, during stormy occasions, cause ship 15 to raise and fall with the action of the waves on its surface. Gangway 20 will then move in the direction of arrows 30A and 30B in correspondence to the rise and fall of the ship. With variation in wind currents and the action of the waves on ship 15, the platform will also tend to move in the direction of arrows 31, causing the platform to lengthen or shorten, thereby releasing the stress on the platform and ball joint 21 and hook means 22. The gangway 20 can be removed from walkway 23 or engaged with walkway 23 by means of crane 35 which has a cable 36 attached over pulley 37 and at point 38 to gangway 20.

A more detailed version of gangway 20 is obtained by reference to FIGS. 2 through 8. Referring specifically to FIGS. 2 through 5, an embodiment of gangway 20 is illustrated and essentially comprises a plurality of rectangular channels 40 and 41. Rectangular channels 40 have a longitudinal slot 42 for receiving a dovetail 43 formed longitudinally along rectangular channels 41. The ends of rectangular channels 40 are attached to a cross-member 44 on each end of the gangway. The inside ends of rectangular channels 40 are attached to a support member 45 by means of a plurality of bolts 46. Rectangular channels 41 are inserted between rectangular channels 40 so that the dovetails 43 mate with the slots 42. Inserted between the ends of rectangular channels 40 and each end of rectangular channels 41 are springs 47. On one of the cross-members 44 is inserted a ball joint mount 48 and on the other cross-member 44 is inserted a hook means 22. In the particular embodiment shown in FIGS. 2 and 3 only a limited number of channels 40 and 41 is illustrated. It is obvious that several sets of channels 41 can be mated with channels 40 and still be well within the scope of the teachings of this specification.

It is obvious that, as tension is applied between hook means 22 and ball joint mount 48, gangway 20 will be elongated. Personnel moving over the top of gangway 20 can lose their footing. To accommodate movement and yet retain footing, an elasticized mat 50 is attached to the top of gangway 20 and to rectangular channels 40. It is preferable to attach the elastic mat only along the end near cross-members 44 to provide a uniform stretching of the mat along the entire length of gangway 20.

Figure 5:
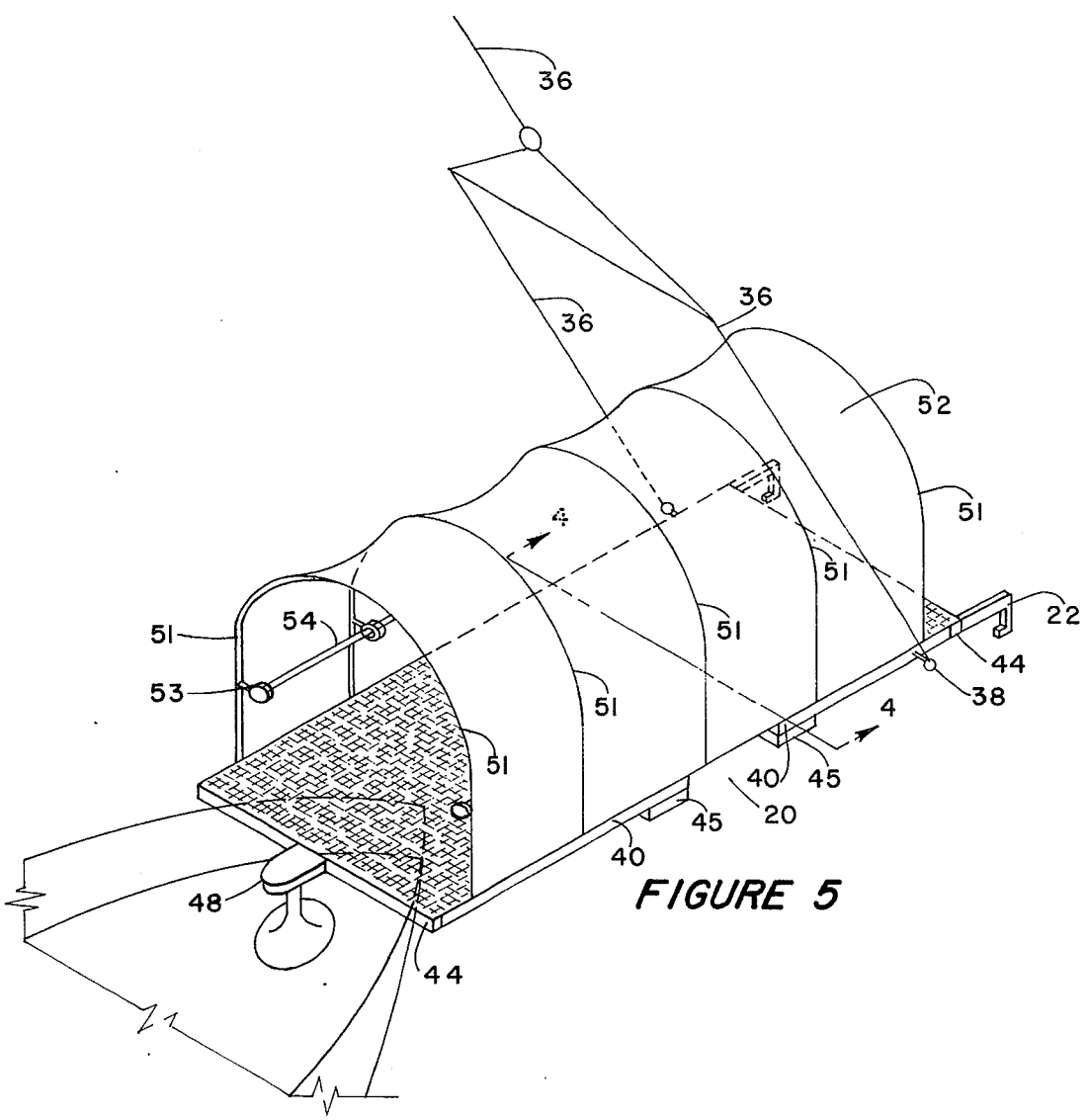
FIG. 5 is a perspective view of a covered gangway of the type illustrated in FIG. 2.
Figure 4:
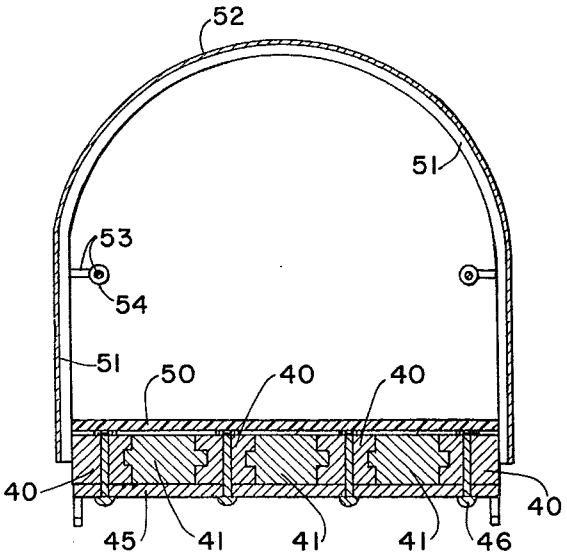
FIG. 4 is a cross-sectional view of a covered gangway taken through lines 4—4 of FIG. 5.

Referring to FIGS. 4 and 5 a cover is provided for gangway 20 to prevent personnel being transferred from accidentally being thrown overboard during a sudden movement of gangway 20. To accommodate the overhead protective cover a plurality of hoops 51 is attached to each side of the gangway 20 to rectangular channels 40. An elastic material 52 is stretched between hoops 51 to form a cover. A plurality of handholds 53 is attached at railing level to hoops 51 by welding or any usual manner. A cylindrically-shaped elastic handhold 54 is attached between handholds 53.

Operation

The operation of the above is best illustrated by reference to FIGS. 1 and 5. Ship 15, traveling in water 25, approaches platform 10 for the purpose of taking on or discharging personnel. Gangway 20 is in a lifted position (not shown). When the ship 15 is within proper spacing from the platform 10, gangway 20 is lowered by means of cable 36 so that hook means 22 engages walkway 23. Personnel can then be easily transferred along gangway 20 to walkway 23 or vice versa. If the seas are rough, ship 15 will be pitching in the direction of arrows 30A and 30B. The above-described pitching causes a high tension on ball joint 21 and hook means 22, enough so that the gangway could become disengaged during the transfer of personnel. In order to provide a means for relieving this tension and thereby preventing disengagement of gangway 20, means are incorporated to permit the gangway to yield lengthwise under sufficient tension or compression. Rectangular channels 40 and 41 are slidably mated to each other through slots 42 and dovetails 43. Springs 47 permit compression or tension when sufficient longitudinal force is applied to the gangway, however, the springs will also return the gangway under tension or compression to the neutral position, that is, a position where all of the springs are exerting the same compression. Thus, if the ship tends to move away from platform 10, the gangway springs will tend to return it toward the platform once the forces causing the ship to move away are reduced. The elastic covering 50 will provide a secure footing for any personnel walking along gangway 20 during the elongation or shortening process. Since the hoops 51 are attached to the sides of gangway and since the material covering the hoops are elastic, any elongation on gangway 20 can also be accommodated by the elastic material 52. The handhold 54 being elastic will also permit elongation or shortening of the gangway. Even if the ship should have a violent pitch and personnel being transferred should lose their footing, the covering 52 would prevent their being thrown overboard.

Modified Embodiment

Figure 8:
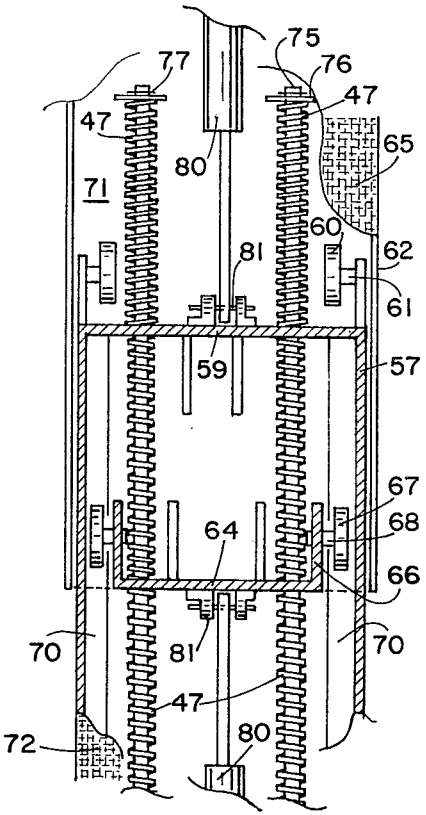
FIG. 8 is a top view of a portion of the gangway illustrated in FIG. 6.
Figure 6:
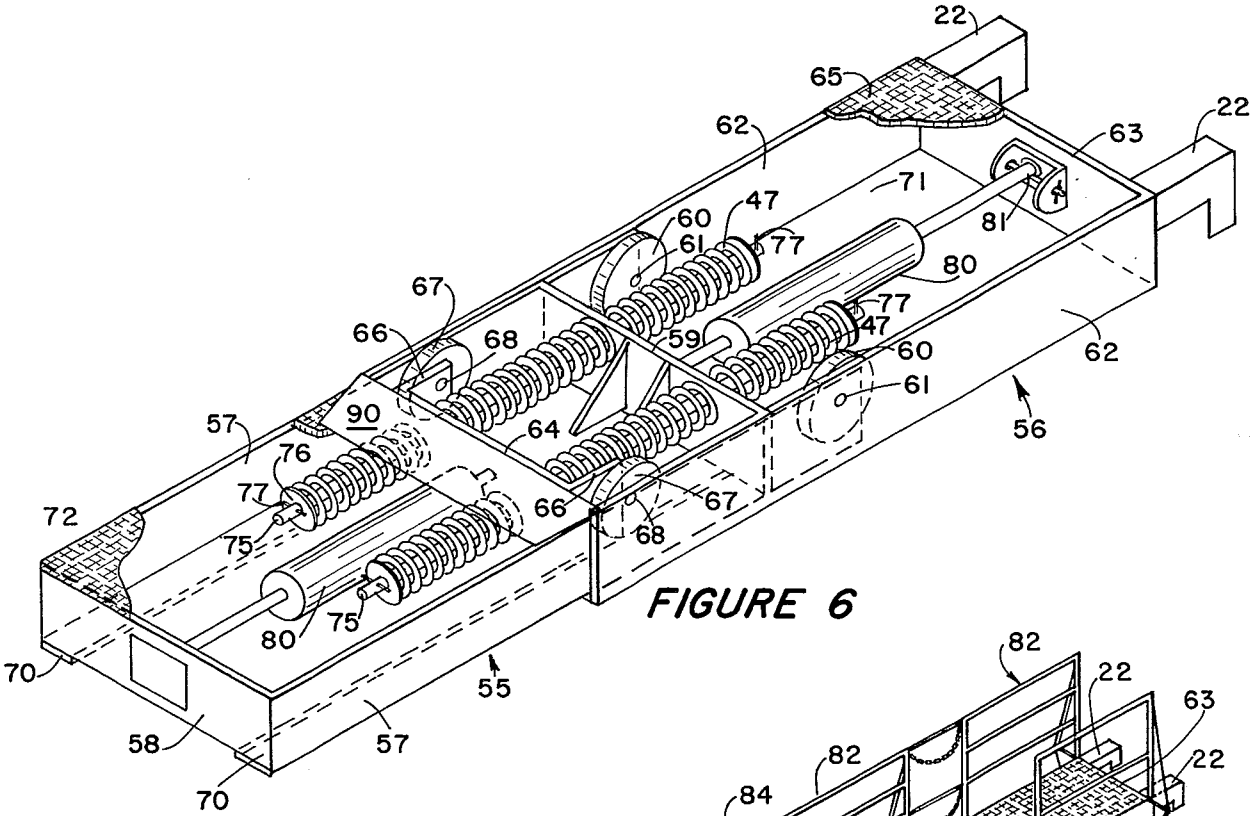
FIG. 6 is a partial sectional view of a perspective of another embodiment of this invention.
Figure 7:
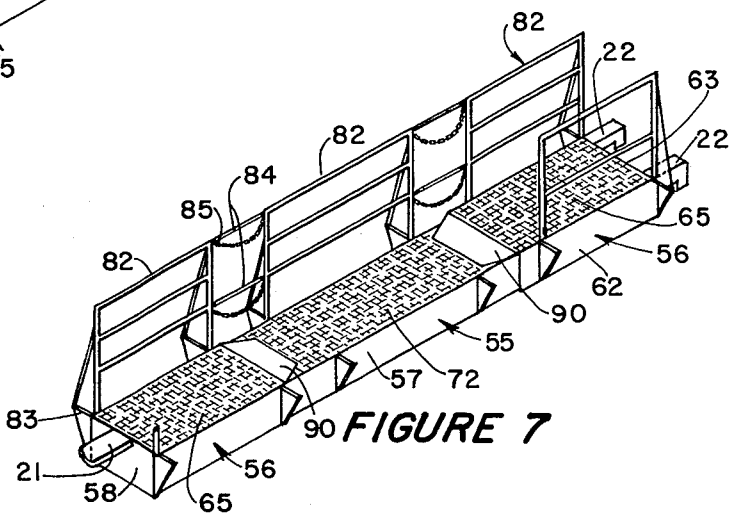
FIG. 7 is a perspective of the complete gangway with part of the railing removed, illustrated in FIG. 6.

Referring to FIGS. 6, 7, and 8 a modified embodiment is illustrated. The embodiment comprises a first section generally referred to by arrow numbered 55 and a second section generally referred to by arrow 56. Section 55 is slidably inserted into section 56 and has side walls 57 and end wall 58 and a second end wall 59. Side walls 57 extend past end wall 59 and have a pair of rollers 60 rotatably attached thereto through axles 61. Second section 56 has side walls 62; end wall 63; and an end wall 64 which is attached to the top 65 by welding or any usual manner.

An extension 66 normal to the surface of end wall 64 is attached thereto and has a pair of rollers 67 rotatably journaled therethrough through axles 68. A roller track 70 is attached along the edge of the bottom of section 55 and provides a surface for rollers 67 to bare upon. Section 56 has a bottom 71 for rollers 60 to bare upon. A top 72 covers section 55. All of the sides, bottoms, tracks and tops, as well as end walls and other positions of the gangway, may be made of any rigid material such as steel or aluminum.

The biasing means is provided by a pair of rods 75 which pass through holes (not shown) in end walls 64 and 59. Springs 47 are mounted axially along rods 75 and are retained at the end of the rods by washers 76 and pins 77. The springs 47, mounted between end walls 59 and 64, are retained by the aforementioned end walls. The length of the springs is selected to maintain a constant bias at all times against the end walls, thereby providing a neutral position so that tension can be applied to end walls 63 and 58 and the gangway will lengthen or compression can be applied to end walls 63 and 58 and the gangway will shorten. The springs, however, in either case will resist the movement of the gangway to lengthen or shorten.

In order to remove any tendency for quick longitudinal movement, a pair of shock absorbers 80 is attached between end walls 64 and 58 on the one hand and end wll 59 and end wall 63 on the other hand. A pivotal connection 81 may be used to attach at least one end of shock absorbers 80 in order to provide some freedom of movement vertically to the shock absorber mounting.

Referring specifically to FIG. 7 hook means 22 is attached to end wall 63 and the ball joint 21 is attached to end wall 28. A plurality of vertical handholds 82 is attached to the side walls 62 and 57 by welding in the usual manner and includes braces 83 for additional support. Elastic members 84 interconnect handholds 82 to provide some measure of support between the vertical handholds 82. A chain 85 may be attached between vertical handholds 82 in order to provide a nonyielding restraining member between the rigid handholds 82.

Operation

The embodiment shown in FIGS. 6 through 8 operates similar to the previously-explained embodiment. As longitudinal tension is applied between end walls 63 and 58, springs 47 between end walls 59 and 64 will be compressed, restraining the longitudinal movement of sections 55 and 56. When end walls 63 and 58 are subject to compression, springs 47 between end wall 64 and pins 77, and end wall 59 and pins 77, will be compressed, restraining longitudinal movement under compression. Shock absorbers 80 will tend to limit the rate at which tension or compression can be applied, thereby preventing sudden longitudinal movement of the gangway. Sliding platforms 90 will provide a ramp for personnel walking along the upper surface 65 or 72 of sections 56 or 55, respectively.

It is obvious that the entire upper surface can also be covered with elastic material 50 to provide a smoother transition to personnel walking on the upper surface when the gangway is under tension or compression during the transition period.

FIG. 6 illustrates a two-section gangway, while FIG. 7 illustrates a three-section gangway. It is obvious that as many sections as needed can be coupled together to form a gangway of the desired length.

While this invention discloses a gangway interconnected between a ship and a fixed platform, it is obvious that the gangway can interconnect two ships in the same manner as that disclosed. The hooks, for example, can be coupled to the railing of the ship or to a specially provided platform on the ship.

In view of the above teachings, it is obvious that changes and modifications can be made in the apparatus disclosed herein and still be well within the spirit and the scope of the invention as described in the specification and appended claims.

What is claimed is:

1. A personnel transfer gangway between a ship and a fixed structure, said gangway having first and second ends comprising:

a. first and second mating extensible member means comprising a first and second set of parallelly-spaced bars, each set having a first end and a second end; means for rigidly securing said first end of each of said sets in a plane; means for slidably interlocking said second ends together; and spring biasing means mounted between said second ends of one set and the first ends of said remaining set;

b. biasing means attached between said first and second extensible member means for forcing said extensible members to a predetermined length wherein force along the longitudinal axis of said mating extensible members will yieldably oppose elongating or shortening of said first and second mating extensible members about said predetermined length;

c. means mounted to said first mating member at said first end of said gangway for securing said first mating member to said ship; and d. means mounted on said second mating member and said second end of said gangway for securing said second mating member to said fixed structure.

2. A transfer gangway as described in claim 1 inlcuding a third set of parallelly-spaced bars each having first and second ends, means for rigidly securing said first end of said third set of parallelly-spaced bars, means for slidably interlocking the second ends of said third set with the first end of said first or second set of parallelly-spaced bars, and spring biasing means mounted between said second end of said third set and said first end of said first or second set of parallelly-spaced bars.

3. An apparatus as described in claim 1 wherein said first and second mating member means are covered with an elastic mat and wherein said elastic mat is secured to said first and second mating member means at said first and second ends of said gangway.

4. An apparatus as described in claim 1 includes a plurality of spaced hoop members attached to the said first and second mating members and extending normal to said plane and elastic means stretched over and between said hoop members.

* * * * *